United States Patent [19]

Israel

[11] Patent Number: 4,466,610

[45] Date of Patent: Aug. 21, 1984

[54] EXERCISE CLUB

[76] Inventor: Terry P. Israel, 1238 11th St., Apt. 8, Santa Monica, Calif. 90401

[21] Appl. No.: 281,067

[22] Filed: Jul. 7, 1981

[51] Int. Cl.[3] ..... A63B 11/00; A63B 21/00

[52] U.S. Cl. ..... 272/93; 272/125

[58] Field of Search ..... 272/93, 67, 125, 68, 272/126, 141, 137; 128/57, 60; D24/36

[56] References Cited

U.S. PATENT DOCUMENTS

| | | | |
|---|---|---|---|
| D. 152,951 | 3/1949 | Eldredge | 272/96 |
| D. 256,841 | 9/1980 | Corbett | D24/36 |
| 654,097 | 7/1900 | Sandow | 272/122 |
| 1,630,467 | 5/1927 | Bradstreet | 272/93 |
| 1,714,391 | 5/1929 | McWhirter | 272/93 |
| 3,268,225 | 8/1966 | Kölbel | 272/68 X |
| 3,637,205 | 1/1972 | Bankston | 272/68 |
| 3,708,164 | 1/1973 | Griffin | 272/67 |
| 3,942,790 | 3/1976 | Rice | 272/126 |
| 4,014,325 | 3/1977 | Clarke | 128/57 |
| 4,165,070 | 8/1979 | Rice | 272/67 |
| 4,248,421 | 2/1981 | Salazar | 272/141 |

*Primary Examiner*—Richard J. Johnson

*Attorney, Agent, or Firm*—Beehler, Pavitt, Siegemund, Jagger & Martella

[57] ABSTRACT

A light weight exerciser or club adapted to assist the user to perform stretching, isometric, isotonic, and isokinetic exercises and to combine them with various the aerobic exercises of walking or jogging. The exercise club has the shape of an elongate cylindrical shaft terminated in coaxially mounted end knobs serving as hand grips and has a length corresponding to the width of the chest of the user. The end knobs are dimensioned to be gripped by the hand with the palm resting against their outer ends with the fingers curving around the edges of the knob. The knobs are rounded in peripheral dimension and continuous to an inner wall which continues smoothly to and joins with the shaft so that the finger tips can lie along and grip the inwardly facing walls of the knob. Means are provided for forming various hand, finger, and thumb gripping surfaces. When the exerciser is constructed of wood such means can comprise grooves formed in the parts by scoring together with scallops formed in the rounded peripheral portions of the end knobs.

9 Claims, 26 Drawing Figures

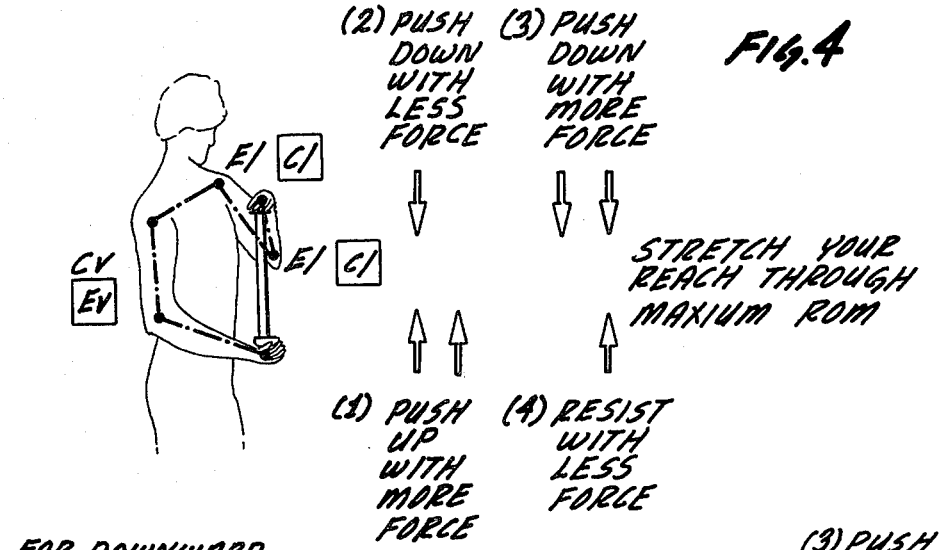
Fig. 4
FOR DOWNWARD MOVEMENT □
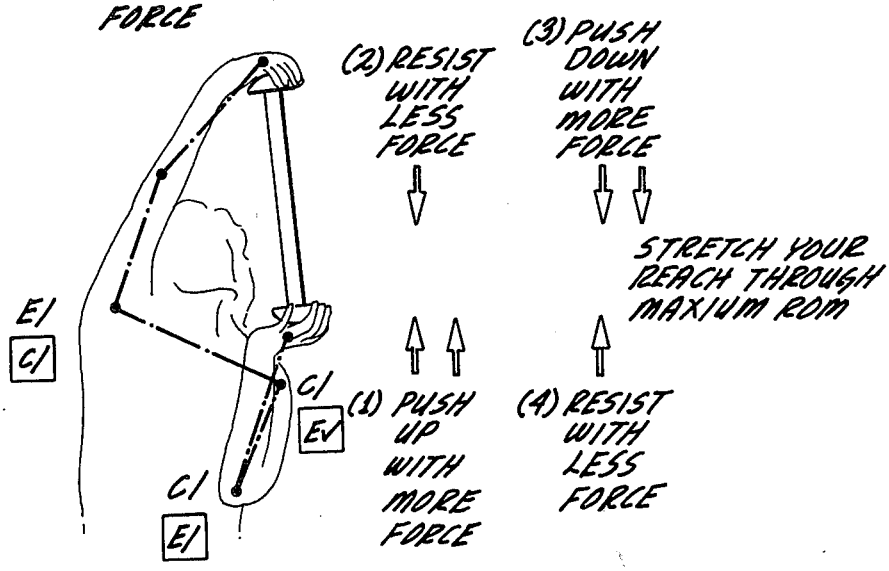
Fig. 5
Fig. 6
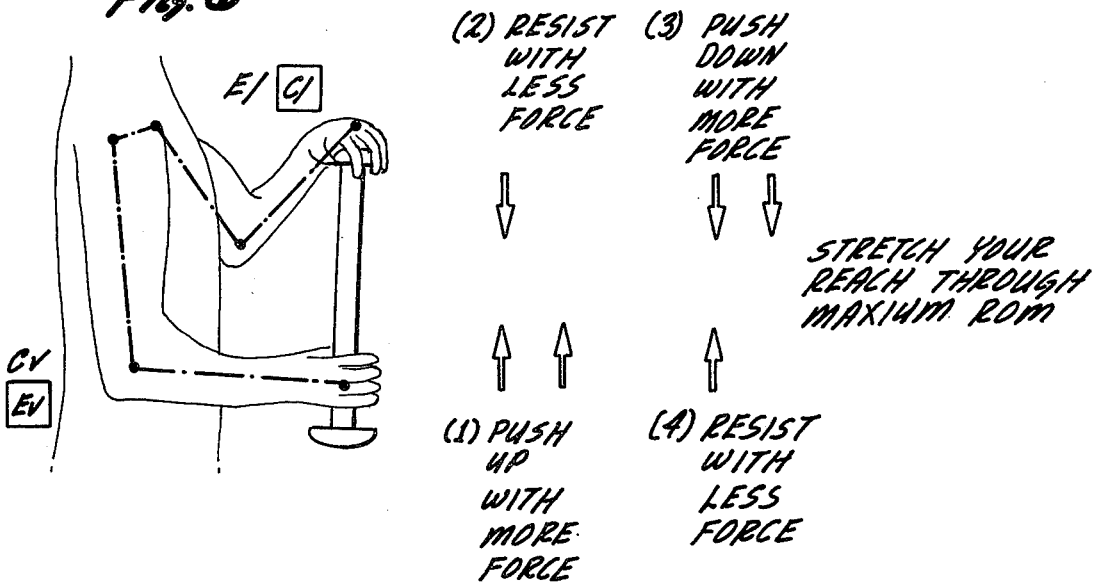

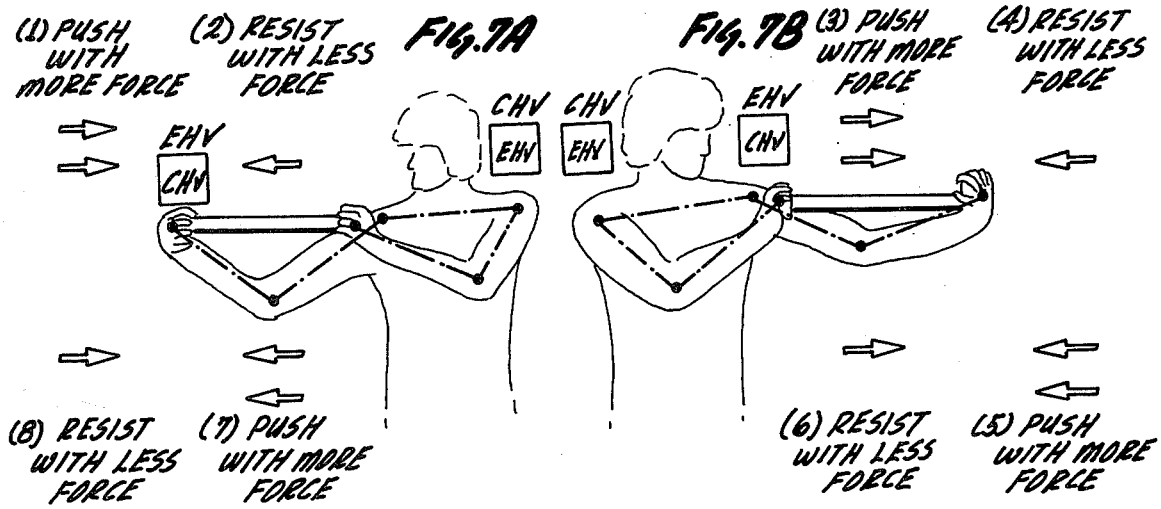
Fig. 7A
Fig. 7B
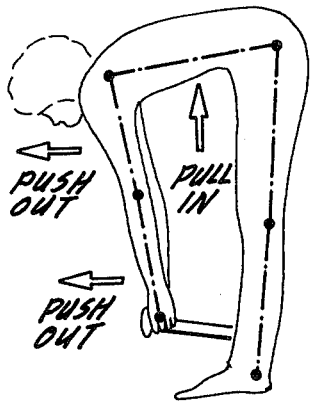
Fig. 8
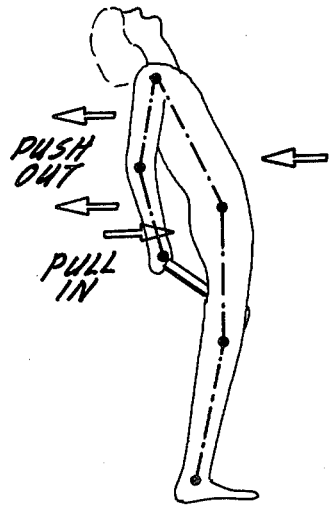
Fig. 9
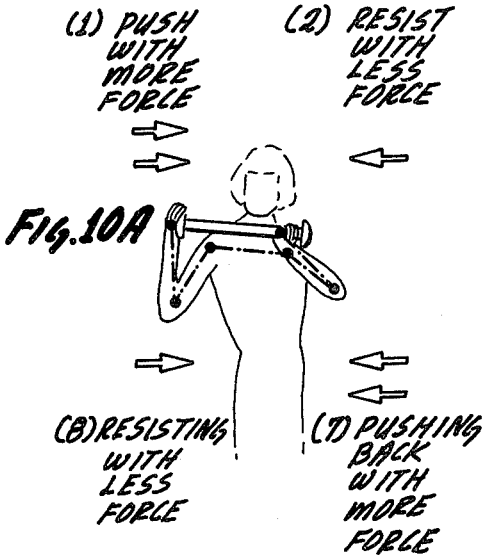
Fig. 10A
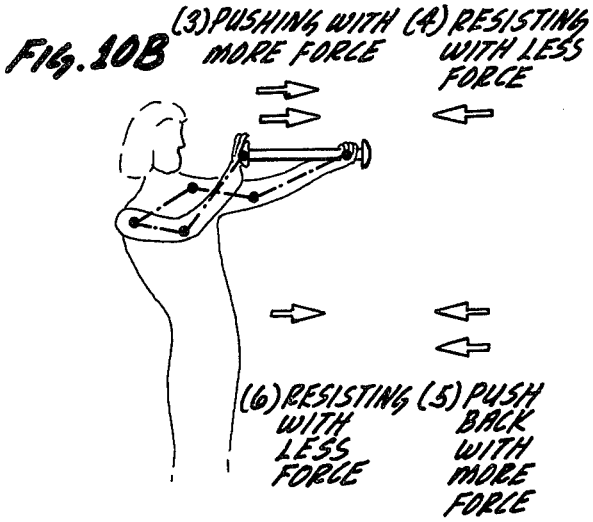
Fig. 10B FIG. 18
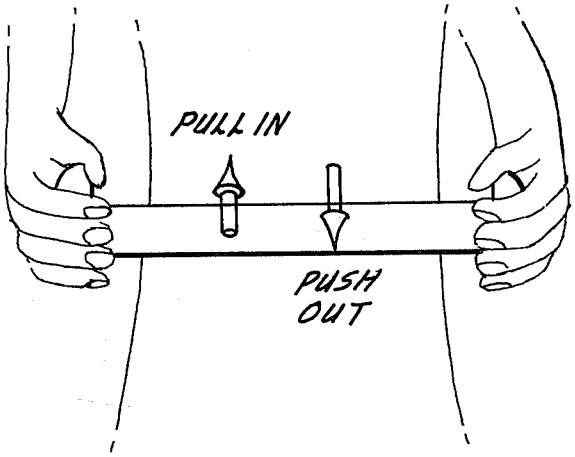
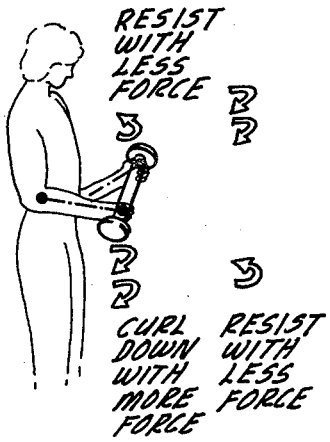
FIG. 19
FIG. 20
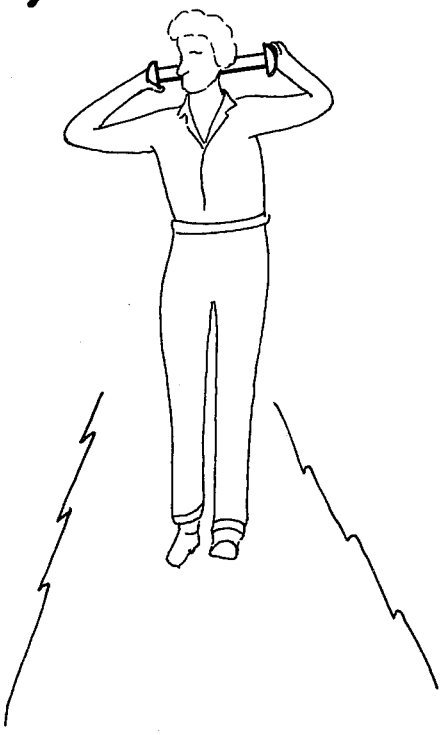
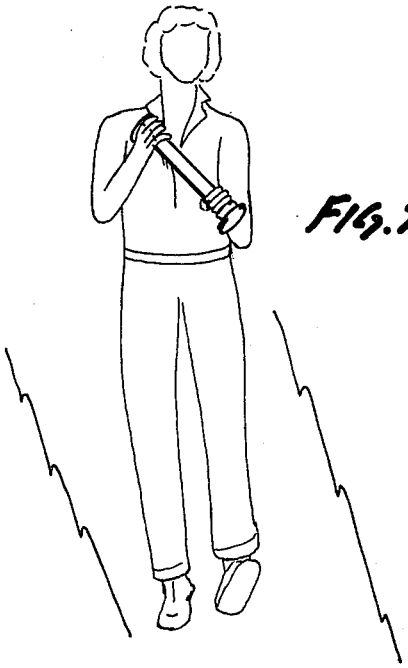
FIG. 21

FIG. 22
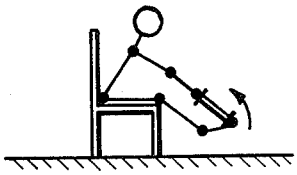
FIG. 23
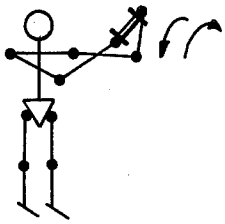
FIG. 24
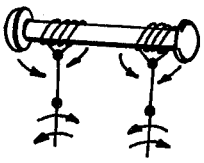
FIG. 25
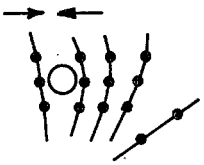
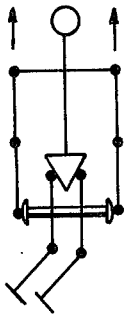
FIG. 26

EXERCISE CLUB

Related to the present application for applicants former design application Ser. No. 77,736 filed on Sept. 21, 1979 now U.S. Pat. No. Des. 264,983.

BACKGROUND OF THE INVENTION

This invention relates to exercisers and more particularly to an exercise club adapted for use by persons of widely varying physical abilities and for use in various body positions while either sitting standing or while walking or even jogging. The device is particularly useful for exercising the upper body. As used herein exercise club and exerciser are synonymous.

In general, dumbell and barbell shaped weights have found extensive use in body training, the weights being generally characterized by a spherical dumbell or disc end weight carried and supported on a central rod or bar, which the user grips. Various lifting motions have been developed for allowing exercise of various upper body muscle groups. Dumbells and barbells are generally formed in two sizes, the small size being adapted for gripping and motion with one hand/arm and the barbell being generally adapted for gripping and movement by both arms and hands together. The former are only long enough to accommodate the grip of one hand while the latter are generally long enough to accommodate both hands when raised to a position outside the breadth of the shoulders. These conventional barbells and dumbells are not adapted for isometric exercise and are not readily portable, due to weight. Furthermore, exercise often requires supporting structures (bench rests) when the weights have been increased to the limit of the individuals capability. Such dumbells and barbells generally serve the function of bulking muscular structure rather than toning of the muscles.

Many variations of the barbell or dumbell shape have been proposed, some in the form of small clubs; those adapted for internal movement to give greater tortional resistance to turning movements and motions and incorporating a wheel from rolling against a fixed surface, such as U.S. Pat. No. 3,708,164, issued June 22, 1973; and those relating to a rod exercise devices adapted to be put in compression by gripping.

It is evident that weighted barbells and dumbells are not adapted for isometric toning exercises, are generally not useful for exercising of the fingers or gripping of the hands as well as being unsuitable for exercise of either abdominals by isometric contraction, or the back muscles as such, although such muscle structures may be involved as a stabilizers in the usual weight lifting exercises. Of the adaptions thereof mentioned above, each fails to provide or to permit use of a complete set of useful exercises which would enable an isometric and isotonic toning of all of the upper body muscle groups and which may further be used to provide a wide variety of isotonic and stretching exercises as well. There is therefore, a need for a new and improved exerciser which will overcome the above limitations and disadvantages.

SUMMARY OF THE INVENTION AND OBJECTS

In general it is an object of the present invention to provide an exerciser which will overcome the above limitations and disadvantages; which provides for an exercise routine which in itself can be accomplished in any position,—sitting, standing, through walking and jogging; which is adaptable to an exercise program devoted solely to isometric exercises or through a limited range of motion; which can be further adapted to certain isotonic and kinetic exercises and which provides for additional stretching exercises; and, as well, combinable with aerobic exercises such as jogging.

A further object of the invention is to provide an exerciser of the above character which requires development of balance, agility, circulation and relaxation and which, when combined with an aerobic exercise, such as vigorous walking or jogging, promotes crculation and breathing as well as giving an overall generally improved feeling of well-being and assertion.

A further object of the invention is to provide an exerciser of the above character which, when used in fast isotonic motion, may develop an aerobic fitness level for the user without walking or jogging.

A further object of the invention is to provide an exerciser of the above character which utilizes no weights, pulleys or complicated equipment, which can be easily used by men and women of any age and, if adapted to the right size, may be used by younger children.

A further object of the invention is to provide an exerciser of the above character which is very useful to the serious athlete who must confine exercise to that level which will deliver the greatest fitness improvement with the least amount of inconvenience.

The exerciser of the present invention is simple, light, and can be kept readily handy in the office, or, when traveling, is useful in combination with running, walking, or about any other activity, where the hands are free.

In general the exerciser of this invention meets and satisfies the entire mainstream of recommended upper body exercises.

A most important object of the invention is to provide a one person exerciser which is adapted for two arm/hand pushing, pulling and stretching where the right and left work in cooperation and opposition to each other.

Another object of the invention is to provide an exerciser of the above character which is particularly adapted for not only maintaining and achieving general physical fitness, but lends itself toward exercises generally considered useful for medical rehabilitation, particularly, isometric and isotonic exercises of low exercision but infinitely variable in load and state of muscular extension or contraction.

A further object of the invention is to provide an exerciser which is particularly adapted towards extensive development of the upper and lower arms, wrists, hands and fingers, so as to provide the user with a means of achieving exceptional strength in the arms and hands which strength is useful in for example the study of the marshal arts.

Another object of the invention is to provide an exerciser of the above character which in a few sizes can accommodate nearly all sizes required for exercise programs involving young people, from the sub-teens through full adult, for both men and women.

As will be disclosed herein, the exercise is shown which is a specifically been constructed for use with an average size adult of about 5' 5" to 5' 10" in height and average comparable body dimensions. The dimensions of the exerciser of this invention is, however, not only useful for this size person but will also serve a much larger and much smaller sizes. It is an invisioned that three sizes will accommodate the average size woman, the medium sized man, and the extraordinarily large man, while an additional size may be required for particularly small people and youths, all being scalable with respect to each other. As will be seen from the following description, the exerciser is also useful for older persons and the infirmed without modification.

The foregoing objects are achieved in accordance with the present invention by providing an exerciser comprising of a pair of end hubs or knobs coaxially mounted to, and supported on, an elongate shaft or staff of cylindrical cross-section. Thus, the present exerciser is similar to a dumbell on a barbell in overall conformation. The knobs and the shaft are interconnected in a no-moving-part arrangement. The shaft and the end hubs are provided with various finger and hand gripping means so as to provide a variety of surfaces for gripping. Thus, gripping means are formed on the elongated shaft for facilitating gripping against rotational movement and consists of a series of elongate grooves, for example, which are spaced about the circumference of the shaft and may be about $\frac{1}{2}$–$\frac{3}{4}$ inch apart. Further gripping means is provided on the shaft for resisting axial movement and consists of a plurality of circumferential grooves spaced about $\frac{1}{2}$ inch apart and extending the length of the shaft.

Gripping means are formed on the end hubs for gripping of the hands and fingers and include a plurality of scalloped, oval appearing indentations circumferentially spaced about the rim of the knob and of sufficient depth and width to receive the fingers. A palm gripping means is provided on the end of the knob which comprises a plurality of radially extending grooves which register each with one of the scallops in the edge of the hub. This provides not only for gripping of the palm against radial movement by those grooves which lie transverse to the palm in any angular position, but also provides for additional finger gripping together with the scallops previously mentioned. In addition, the inside surface of the knob is substantially flat as it extends towards the shaft and then curves in progressively greater radius towards the shaft to provide a smooth region for large contact with the surface of the finger tip to a contact gripping surface. In addition, circumferential grooves are provided on the inside face of this portion of the knob for additionally holding the finger into gripping contact against sliding away from the shaft as the club is used. The shaft length extends about chest width (i.e., to an extent just inside the shoulders) and has a circumferential dimension about the same as, or slightly less than, that of a tennis grip. The knobs at each end are about hands-breadth in the diameter as taken from the first and second joints of the fingers through the joint of the thumb when the same are laterally extended and the palm in contact with the knob. A suprising number of exercises, all of which are distinct, can be programmed for use with the exerciser of the present invention. Included in the present specification are specific dimensions for making the exercise bar constructed in accordance with this invention in proportions for an average sized person together with specific examples of the muscle groups which are employed in performing various of the programmed exercises. These exercises provide for primary actions about the elbow joints, provide for horizontal shoulder movement including adduction and abduction as well as medial and lateral shoulder rotation and for spinal bending and rotation as well as dorsal flexion. Additionally finger adduction, wrist flexion in pronation, and supination as well as ulnar/radial abduction are also included.

These and other objects and features of the present invention will become apparent from the following detailed description when taken in conjunction with the accompanying drawings of which:

BRIEF DESCRIPTION OF THE DRAWINGS

FIGS. 4–22 are illustrations depicting exercises employing the exerciser of the present invention, showing the same in outlines enclosing stick figures commonly employed for illustrating body positions and kinesiology.

FIGS. 23–25 are further stick figures showing additional exercises adapted to be done with the exerciser of the present invention.

DESCRIPTION OF THE PREFERRED EMBODIMENT

Figure 1:
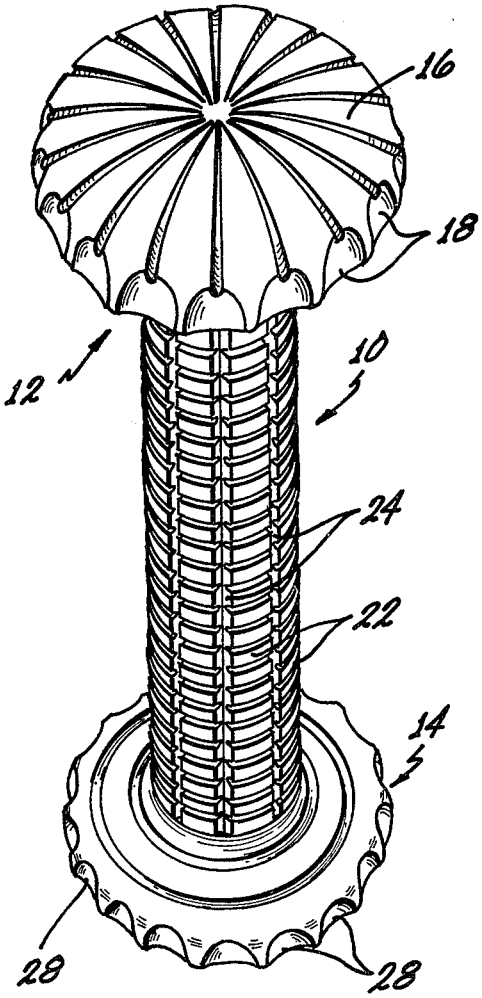
FIG. 1 is a perspective view, taken from above, of an exerciser constructed in accordance with the present invention.
Figure 2:
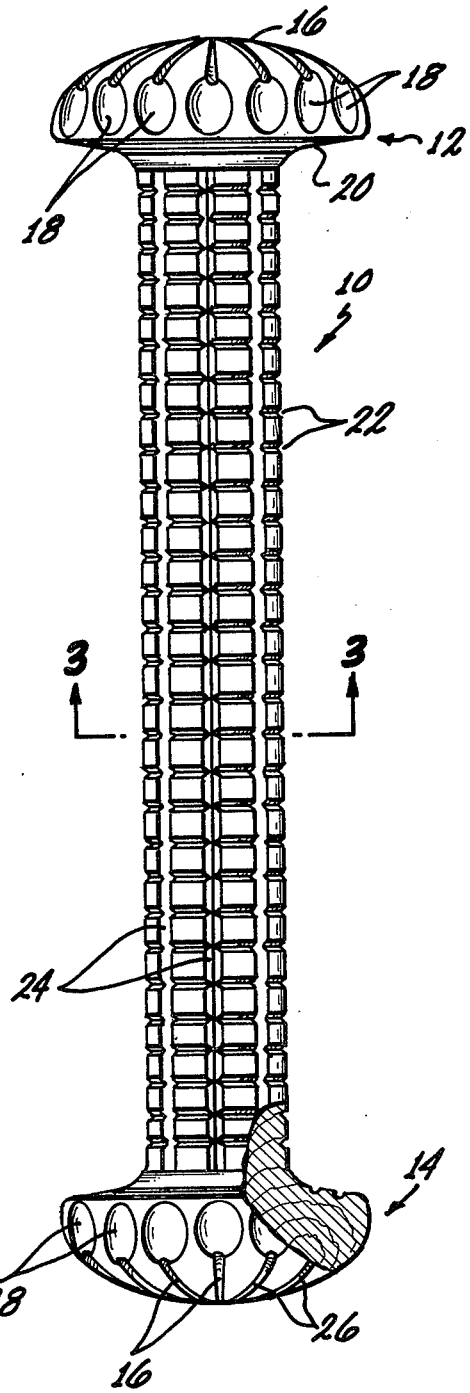
FIG. 2 is a side elevational view of the exerciser FIG. 1 with a portion thereof broken away to illustrate the construction of the end knob.
Figure 3:
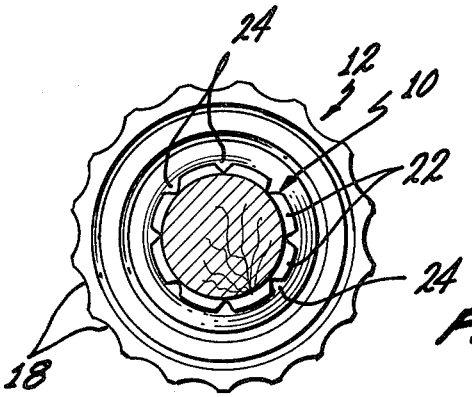
FIG. 3 is a cross-sectional view taken along the lines 3—3 of FIG. 2.

Referring now to FIGS. 1–3 the exerciser of the present invention as shown in detail and is generally characterized by being formed of an elongated shaft or staff in the form of a cylindrical rod to which it is coaxially mounted at each end, one of a pair of hand grips 12, 14 each having the form of a knob of enlarged proportions defining an outwardly facing convex end face 16 adapted to lie in contact with the palm of the hand of the user. Each end face is bordered by peripherial rounded region 18 about which the fingers may curl and also forms an inwardly facing annular surface 20 which joins with the shaft in a continuous curve and which provides a finger tip contacting surface inward facing 17 so that the palm and finger tips may work against each other on the opposed inner and outer surfaces 18 and 20, while the fingers themselves are in close contact with the rounded region. Thus, the grips altogether comprise a well formed gripping surface adapted to shape to the confirmation of the closed hand. The overall length of the club is about chest width for reasons will be hereinafter explained.

All surfaces are adapted for gripping, the end knobs being particularly adapted for gripping of the hand, palm and fingers including the joints while the shaft itself is scored for gripping of the hand.

Thus, means is provided on the shaft for forming a hand gripping surface and consisted of first plurality of peripheral perential grooves 22 which may be V-shaped in cross section and regularly spaced at about one-half to three-quarters inch intervals along the length of the shaft. These circumferential grooves 22 prevent endwise slippage of the hand in pulling motions along the rod. The second plurality of axial grooves 24 are formed along the shaft and may also be V-shaped in cross section and regularly spaced about one-half to three-quarters of an inch apart. Grooves 24 give grip to the hand against twisting motion about the axis of the shaft. The embodiment of FIGS. 1–3 can be made of wood which is light of weight is easily formed into the shaped desired and can be given the scoring and other surface features for gripping as set forth herein. In wood, the grooves shown are generally triangular in cross section and have a depth of about an eighth of an inch and a width at the surface of about the same, an eighth of an inch. It will be appreciated that if the exerciser of the present invention were constructed of other materials that a different gripping surface could be provided, thus, if molded of plastic such as polypropylene wherein other types of surface deformations can be by molding formed, cross hatchings or other surface indentations of various kinds may be substituted for the grooved gripping surfaces set forth. If molded of semi-rigid rubber, the feel of which is resilient it may be that the surface friction and the resilience of the rubber in and of itself may provide a good gripping surface. In that connection the gripping surface could also be formed in the manner of the construction of tennis racquets, wherein a resilient, pliable leather-like waffle wrapping is given to the shaft.

The end knobs shown in FIGS. 1–3 are also made of wood and are formed and dimensioned in a shape so as to adapt to the hand for gripping, not only for surface friction contact, but also for close conformation to the shape of the hand as the fingers are curled towards the palm. Thus, the outwardly facing end wall or face 16 is provided with the concave surface which conforms to the palm shape in gripping the same and is further provided with a palm engaging radial grooves which radiate from the center to the outer peripheral edge of that face, so that certain of the grooves will cross the palm ridge from the heel to the base of the thumb and give a good grip against slipping. The periphery of the knobs are rounded between the inner and outer faces and are generally circular as viewed from the end. They are further provided with a plurality of finger gripping recesses in the form of scallops 28 having an appearance resembling a regular array of oval figures, enlongate in the direction extending between the inner and outer faces of the knob so that the inside of the fingers can curl around the edge of the knob and through the individual recesses. In this way, the raised portions between each recess can be engaged by the fingers against the turning motion of the hand. For appearance and for good function the radial grooves and scallops are of the same number, each groove intersecting a given scallop. Not only does each end knob provide an excellent gripping conformation and surface for each individual hand, but the curved palm fitting end faces coact to form a hand-to-hand stable pushing surfaces. When relying on palm-to-palm isometric pushing the palm curved surfaces are centered on the axis of the exerciser and are directed toward and near to the opposite palm face. This results in a comfortable, stable feel to the user, permitting reasonable isometric exertion, from which the user fatigues in a satisfactory manner before becoming aware of either the weight of the exerciser or any difficulty or instability in performance attributable to losing control of the exerciser position.

The inside facing walls of 20 of the knob are contoured and smoothly joined from the outer rounded edge through to the shaft itself. In general, the region between the wall 20 and the rounded region is convexly curved a slight amount while the portion extending from the wall 20 toward the shaft is reversed or concave curved. These curves are not well emphasized in the drawings and but are important for user comfort. The curves may be approximated by sections of the frustrums of appropriate conical surfaces. Together, the concave curve, the convex curve, and the inner facing wall conform well to the shape of the inside of the curled finger from the distal joint to the tip. This in itself gives an excellent non-slip grip. Further the inside wall is provided with a plurality of circular concentric grooves 32 which further give a finger gripping function at the central portion of the finger tip itself. In all, each of the grooved gripping surfaces described provides an especially enjoyable tactile feeling to the user.

The dimension of the exerciser of this invention is particularly important. The end knobs are dimensioned to conform to the hand so that the palm to the first finger joint can lie against its convex surface 16, the rounded peripheral region is deep enough for the finger to curl around it in conformity from the first joint to the second joint and through this scalloped recesses therein and, and for the thumb to do likewise diametrically across from the fingers; and the remaining depth of the inwardly facing wall in associated curved surfaces conforms to extend between the first finger joint and the finger tips almost to the nail.

If capital D is given as the hand grip dimension, and that is given as the diameter of the knob, then the axial thickness of the knob is about 0.4 D in inches for an average man, these dimensions are about 4 inches and $1\frac{3}{4}$ inches respectively.

The length of the exerciser is almost chest width, slightly more than to about 3 D or, in inches, about 14 inches for the average man. The shaft is about a tennis grip in diameter or about 0.5 D which for the average man is about 1.95 inches.

These dimensions, particularly that of the length of the exerciser, as determined by the shaft as well as the form of the end knobs and its dimensions are critical and have been developed through a painstaking appraisal of the exercises to be performed.

The shaft diameter is slightly larger than a tennis handle grip for the same person to thereby provide a better grip for axial turning motion compared to the smaller tennis grip which facilitates lengthwise rigidity of the arm-hand-racquet combination.

The exerciser can be made of wood or plastic such as polypropylene, polyvingleloride or a hard rubber. In all cases the exerciser should be as light as possible, i.e., of slight possitive to neutral buoyancy in water. In woods, this usually results in full section material. In plastic, hollow sections can be used to maintain desired weight and to reduce costs.

EXERCISE PROGRAM SPECIFICATIONS

The exerciser of the present invention finds widest application in the isometric and isotonic exercise of the upper body. In order to use the same, various positions are found to most useful and will be reviewed in connection with FIGS. 4–25. The exerciser permits considerable changes in variety in type of exercises which may be performed. The exerciser may be held either in the front or in back of the person, or to the side and may be held high, low or at any intermediate position, including positions which are either further away or closer to the body. As known, isotonic contractions of muscle groups involve a change in the length of the muscle which occurs during the movement of the various body segments. For example, in lifting an object the biceps muscles of the upper arm are used in an isotonic contraction which moves the forearm to a closer angular position to the upper arm by shortening the biceps muscle. In contrast, isometric (static) contraction is utilized in a way in which muscles, while applying tension, do not shorten or lengthen and, therefore, do not move any body segment. Generally, isometric contractions involve a static condition of the body segments and require a contraction up to from two-thirds to maximum contraction strength with a duration of 5 to 10 seconds. Repetitions of between 5 to 10 are commonly specified. It is also known that isometrics are specific to in a limited range about the angle of contraction, normally about 15 (fifteen degrees). Therefore, in order to properly exercise a muscle by the isometric method, several points in the range of motion should be utilized. As will be seen, the isometric exercises proposed for use with the present invention permit the utilization of suitable forces up to the maximum force, involve no movement of the exerciser and are adapted to be used at various points in the range of motion. Furthermore, isotonic exercises are also provided in which the exercise is moved slowly and evenly from one point in the range of motion to another utilizing near maximum force of near maximum resistance. In aerobic user the exerciser may be moved briskly rising high force with low resistance. Gripping motions of the exerciser for exercise of the hands and fingers as well as the muscle associated with the arm muscles associated with hand movements is particularly versatile, many such grips being possible and involving movements of the hand in pronation, supanation or in the plane of the wrists.

In general the various exercises are samples of an infinite variety and may be done in any order. A new exercise is created whenever the user changes position, movement or grip. The following summary chart may be a useful reference:

| Position of the Bar in relation to your body | Movement | Grip |
|---|---|---|
| Hold bar | Isokinetic and Isotonic | Grip changes |
| in front<br>in back<br>to the side | Maximum force with near maxium resistance. | each time the direction of the palm is facing is |
| Hold it | Bar moves slowly | changed. |
| high<br>low | and evenly. | There are |
| in between | Isometric | many |
| Hold it | Maximum force with maximum resistance. | combinations. |
| in<br>out | Bar doesn't move | |
| | Aerobics | |
| | Maximum force with little resistance. Bar moves briskly. Bar swings rapidly. Add walking. Stretching, to stretch, push/pull in limits of body movements. | |

The following discussion will help define the terms and actions of this exercise system. Isokinetic (Isotonic-)—maximum force against near maximum resistance at an even rate of speed throughout the entire movement. One controls the rate of speed and amount of force used. Force used in push and resistance progresses as your strength increases. Aerobic—brisk movements using very little force for an extended period of time. Isometric—maximum force against immovable resistance. Apply total force and hold for 6 seconds, extending this period to 12 seconds as your strength and endurance increase. Continue to breathe comfortably during the entire exercise. People with heart conditions should not do isometrics. Stretching—extend reach fully in each exercise by lengthening the muscle rather than contracting or shortening it.

Referring specifically to FIG. 4, the motion is indicated in steps of 1 and 2 for upward movement of the exerciser while steps 3 and 4 indicate downward movement. The following figures show both in body form and the enclosed stick figure the orientation of the shoulders arms and hands. The abbreviation ROM is used to indicated "range of motion." The various symbols for the movements are indicated by the following key:

C=Concentric
E=Eccentric
/=Extension
F=Flexion

Thus steps 1 and 2 involve eccentric extension with respect to the left shoulder and elbow while the right shoulder and elbow undergo concentric flexion. Steps 3 and 4 are indicated by the movements as shown in boxes. In general this exercise is reversible and for the upward motion of steps 1 and 2 indicates the primary movers to be at the biceps brachii, brachialis, brachioradialis, wrist flexors stabilized by the anterior deltoid, pectorialis major and trapezius. The left arm in the same motion has a primary movement of triceps brachii, latissimus, doris, trese major, wrist flexors, posterior deltoid stabilized by pertorialis major, trapezius. Thus, it might be pointed out that it is important that the various stabilizing muscles be properly exercised and understood as well as the primary moving muscles. Thus, the pectorialis major keeps the arm moving away from the body when performing the pushing movements here, but is is relatively statically involved since it causes or involves very little movement if any. Likewise the trapezius muscle in the upper back serves as to stabilize the entire shoulder girdle.

FIG. 5 involves a similar set of isotonic exercises with the exerciser beginning at substantially above the head level, the upper extent being indicated. The primary muscles involved are: anterior deltoid, pectorialis major, tricep brachii, wrist flexors serratus anterior trapezius, for the left arm and pectorialis major, latissimus dorsi, teres major, trapezius, supraspinatus for the right. In the upward movement of steps 1 and 2 and reverse in steps 3 and 4.

FIG. 6 is a variation of FIG. 4 with the hand gripping the rod and shows one of a variety that may be selected. The primary muscle groups involved are: brachio radialis biceps brachii, brachialis, radial abductors. Stabilized by all wrist hand fingers, anterior deltoid, and for the right arm and triceps, posterior deltoid, wrist flexors primary groups in the left arm must be stabilized by pertoral major, latissimus dorsi, teres major.

FIGS. 7*a* and 7*b* illustrate a sequence of movement in which the exerciser is held generally horizontal and at shoulder level and moved from side to side, movements 1–4 comprising the first group, while 5–8 comprise the last. The primary muscle groups involved in this exercise are pectoralis major, anterior deltoid, biceps brachii, brachialis, wrist flexors.

FIG. 8 illustrates a total body isometric which is very good for the stomach muscles and may be performed as shown or in a seated position with the legs flat on the floor. This exercise should be developed slowly and the position of the exerciser along the legs varied to provide as many points along the range of the range of motion of the various muscle groups as useful. The primary muscle groups are dactoid, pectoralis major, erector spinae, gluteus maximus, hamstrings=bicepfamoris, semimembranosus, semimendonosus. Not only may the bar be brought to the knees but it also may be placed out at the toes and a pulling variation of this exercise developed.

FIG. 9 shows a reverse of the isometric FIG. 8 in which the combination of pulling in the butt while pulling in the stomach or abdomen is utilized. Neither isometrics of FIGS. 8 and 9 should be used when back trouble is present. The primary muscle groups used in FIG. 9 are posterior deltoid, teres major, latissimus dorsi, triceps brachii, ulnar abductor, posterior tilt=-gluteus maximus, hamstrings, rectus abdominus. FIG. 10 illustrates a fore and aft movement of the exerciser similar to the isotonic exercise of FIG. 7.

FIGS. 10A and 10B illustrate an isotonic exercise having a forward movement in steps 1 through 4 and backward movement in steps 5 through 8. In steps 1–4 the following muscle groups are utilized: pectoralis major, anterior deltoid, triceps brachii, coraco brachialis for the right shoulder and arm while the left shoulder and arm utilize: biceps brachii, brachialis, pectoralis major, anterior deltoid. In the reverse direction of 5–8 the symmetry of muscle groups reverses the above. In this exercise it is recommended that the shoulders be maintained in coronal plane for maximum range of motion. It will be noted that the hand grip is shown as supanate to the shaft which is recommended for comfort.

Figure 11A:
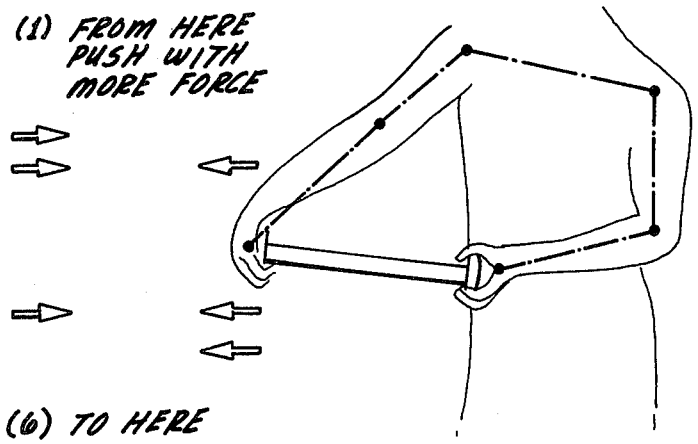
Figure 11B:
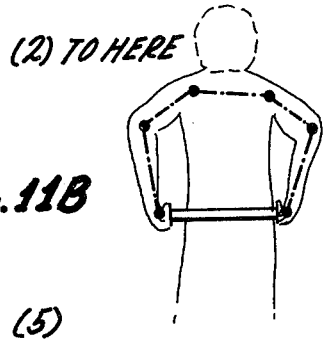
Figure 11C:
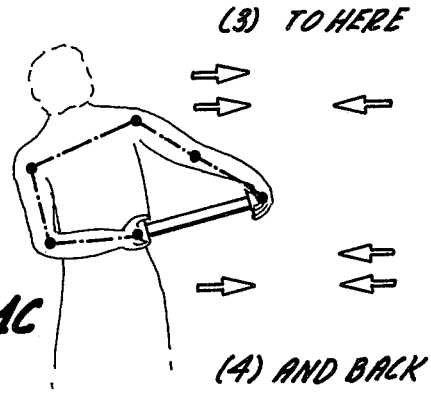

FIGS. 11 show a posterior to anterior view of the user in an exercise which involves primarily adduction of the shoulder and elbow of both arms. Accordingly, in the first series of steps of the isotonic motion will involve a concentric adduction of the left shoulder the right shoulder will have an eccentric adduction. This exercise is quite reversible and syndrical. The arm employed for pushing will involve the following muscles used in adduction: anterior deltoid, pectoralis major, tricep brachii, wrist flexors, serratus anterior, trapezius: stabilized by the rotator cuff. The other set of muscles used in pulling will involve the pectoralis major, latissimus dorsi, teres major, trapezius supraspinatus. The stabilizers used for induction are: brachio radialis, biceps brachii, brachialis, radial abductors. A particular advantage of the exercise program as described is that a considerable time savings is obtained for the user to work the antagonist or the opposing muscle group immediately after working the agonist or the muscle initially worked, this helps considerably to prevent muscle imbalances from developing from or being caused by exercises. This is possible because one is able to push in one set of exercise to pull in another set, and to immediately reverse these actions. For example, if the user is performing all horizontal flexions for several sets of several seconds, then he can immediately perform horizontal extention in the shoulder following that so as to help balance the muscle groups. This is to be distinguished from a weight programs in which repetitive forms of one type of movement is involved and the set up time required to rearrange the equipment normally required in weight training creates such a lag that by the time that you get around to it, it doesn't have the appropriate effect. It should be pointed out that the exerciser of this invention is exceedingly convenient and portable and may be easily taken with you so that these exercises can be accomplished in many more places than possible with a standard weight training program.

Figure 12:
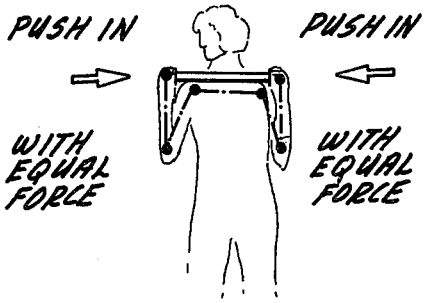
Figure 13:
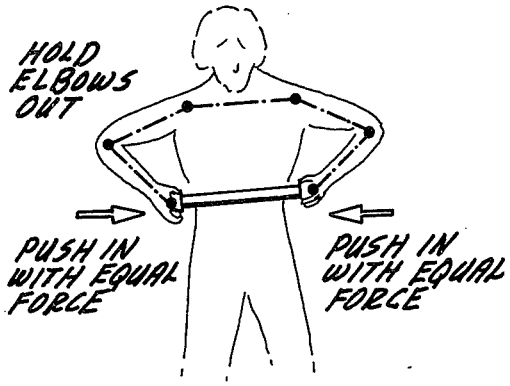

FIGS. 12 and 13 refer to isometric exercises involving change of position. Initially, the bar is held about chest high, the knobs being gripped with each hand, palms facing in. The forces issued promote the hands equally pushing so that the bar does not move. This is position is held with the energy flowing continuously through the arms for 5 to 12 seconds. The bar may be held close to the body or further out, or, the elbows may be held in or out to provide a variety. With arms held vertically and close to the body the user obtains a certain amount of rotation within the shoulder, medial rotation, since one is attempting to rotate the humorous inwards, and by doing that will bring in the medial rotators including the pectoris major, teres major, the latissimu dorsi and a muscle that is very difficult to exercise deep in the back (subscarscapularis) as well as the anterior deltoid and wrist flexors. In FIG. 13, the attempt to abduct at the shoulder reduces the amount of medial rotation and shifts the exercise to a higher degree the pectoralis major and the anterior deltoid. Also, FIG. 13 wherein the exerciser is held at about waist level involves another set of muscles in exerting the primary forces: pectoralis major anterior deltoid, coracobrachialis, wrist flexors, some bicep, tricep.

Figure 14:
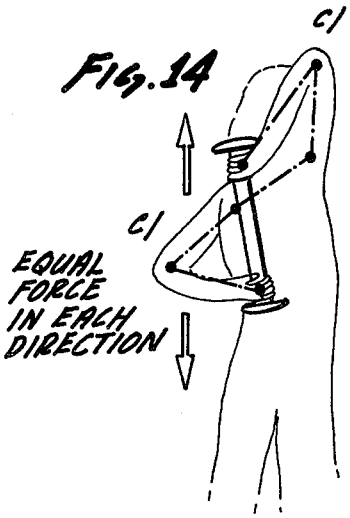

FIG. 14 illustrates another type of isometric exercise utilizing a large number of the back muscles across which the bar is gripped, the bar being held in the back with one arm bent, the one arm reaching over the shoulder to hold the top of the exerciser while the first arm reaches downward across the lower back and grips the exerciser shaft. One arm pulls up and the other pulls down with equal force to create the isometric exercise. As a variation, a person with a great deal of flexibility may grip the shaft so as to bring their hands closer together this variation being useful to obtain a greater amount of flexibility. The muscles involved are primarily the triceps and to the lesser degree the teres major and posterior deltoid. Along the lines previously mentioned, the isometric exercise once completed, can be followed by a relaxation after which stretching of the muscle groups may be tried by performing an extension in the elbow and shoulder. In this way the arm that was just performing an extension may be stretched by gently pulling down on the bar with the lower hand to increase the flexibility of the extensors of the elbow and shoulder. This is conveniently done in the resting interval before performance of the next movement or programmed exercise. It should be noted here that certain exercises involving tension in the shaft are set forth in which the inwardly facing knob walls are used together with gripping of the shaft to stablize the position of the hands, as will be apparent also from consideration of FIGS. 15 and 16.

Figure 16:
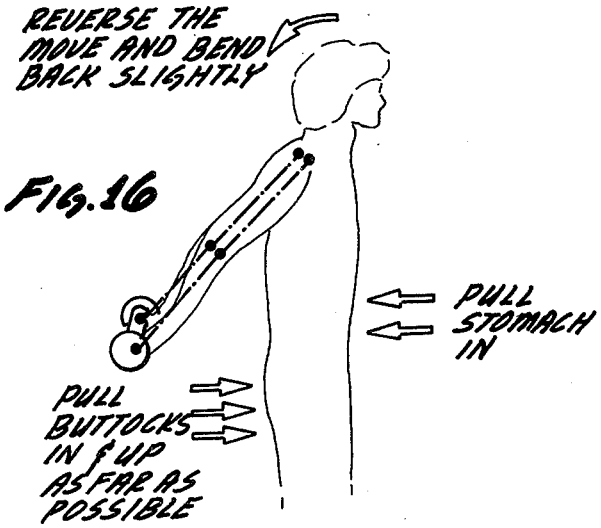
Figure 15A:
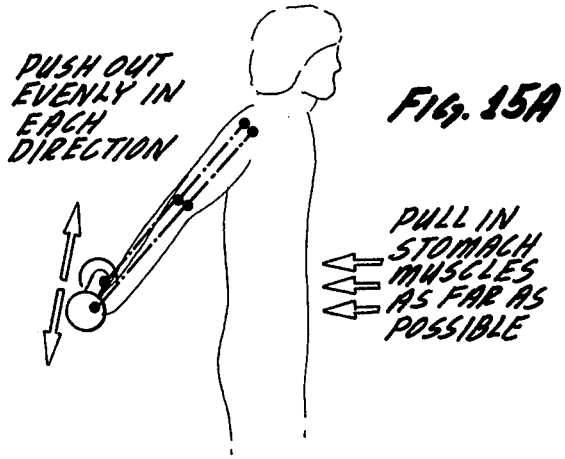
Figure 15B:
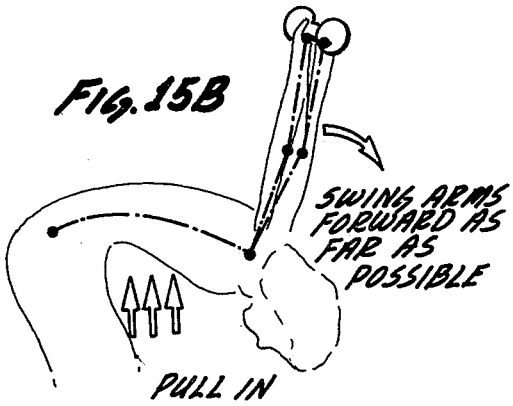

The primary object of exercise shown in FIG. 15 is to exercising the arm, shoulders, in combination with buttocks-abdomen effort. Thus the primary idea is that the exerciser is held in back of the user pushed out and pulled out by the motion of the hands. This portion being somewhat similar to an isometric exercise, the upper body being swung forward in combination with the stomach tuck and the pulling of the buttocks in as the upper body rotates. The main point to be observed in this exercise, program is that the arms, shoulders, and back can be combined within a movement with the abdomen and buttocks, and that even leg stretching is involved. Initially, the bar is held behind so that the shoulder is in hyperextension and the elbow in extension, an attempt is made to pull the hands apart or to abduct the shoulder, from there progression is made into an eccentric hip extension in an eccentric spinal fluction while the knees remain extended. This helps to stretch the hamstrings and to a certain amount the gastrocnemius. From there the user contracts the abdominal muscles and proceeds through a concentric hip extension and spinal extension coming back to an erect position. One can then attempt to do a static contraction of the gluteus maximus or the buttocks antigate of posterior tilt of the pelvus to relieve pressure on the lower back. FIG. 16 illustrates a continuation of the exercise of FIG. 15 in performing posterior tilt in which the abdomen is pulled in as well as the buttocks. This involves the erectus muscle, in the front of the abdomen, the obliques and the hamstrings. This exercise should be repeated several times each day for proper posture and flattening of the abdominals.

Figure 17A:
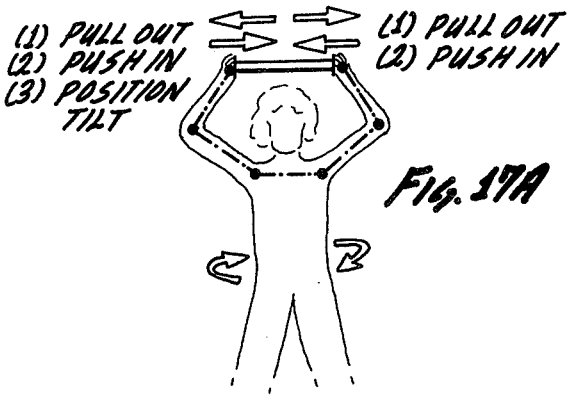
Figure 17B:
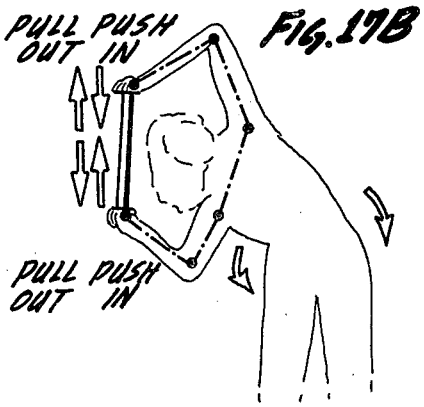

FIGS. 17 illustrate a combined exercise involving a twisting movement or spinal rotation, the bar being held overhead with the elbows flexed so that the user can either push or pull changing the muscle groups accordingly. When pushing the following primary muscle groups we used: deltoid, supraspinatus, trapezius, biceps brachii, brachialis, wrist flexors, pectoralis major, stabilized by the rotator cuff and cerratus interior. When pulling apart the following primary muscle groups are utilized: deltoid, latissimus dorsi, teres major, triceps brachi, wrist extensor, wrist flexors, pectoralis major. In both rotational and lateral flextion of the spine, the following abdominal muscles are utilized: rectus abdominus, internal oblique, external oblique, transverse abdominals and rector spinal.

FIGS. 8A and 8B and 11A and 11B illustrate the considerable versatility of the exerciser of the present invention. Generally the exerciser is held horizontally with the hands gripping and pushing towards each other from opposite knobs. The exercisers as shown are held approximately level with the shoulders and a fore and aft motion or side to motion is indicated. In FIG. 8 the primary working muscles are the horizontal flexors and abductors. These muscles are primarily located in the chest and in front of the shoulder. One also brings in the biceps of the arms because of a certain amount of elbow flexion as well as, the resistance to the opposite arm. Thus, the major muscle groups of the pectoralis major, anterior deltoid and biceps brachialis are involved as well as the wrist flexor. As the exercise proceeds the emphasis is on eccentric horizontal fluction of the shoulder in the right shoulder and concentric horizontal flexion in the left shoulder. The elbow meantime is going through given a limited amount of movement. Both sets of muscle groups from each side of the body are working bilaterally, albeit in reverse and opposition, so that one elbow flexor is working against the opposite elbow extensor with the pectorialis majors interior deltoids biceps and brachialis working against each other at the same time. As previously noted, muscles need to be worked throughout various portions of the range of motion when done in isometric and throughout different configurations. When done isotonically with the present invention the exerciser may be held across the body in higher or lower positions and with a somewhat different expected results. Thus, the large muscle in the chest called a pectoralis major is fan shaped and has fibers going in many different directions. With the present invention, the user can bring the different force lines passing through that muscle strongly into play in accordance with the elevation in which it is held. In addition, the elbows may be held a little higher and away from the body so that they abduct the shoulder. This also will bring together a different array of muscle fibers within the groups being exercised. Further the variations may also include lowering or raising the exerciser to obtain different angles of attack from the muscle groups. It should be pointed out that inasmuch as the exerciser is relatively light and unweighted, it permits these changes to be accomplished within a given workout. Were the exerciser weighted, then it would just not be possible within the fatigue limits of the average individual to make the changes suggested here. More specifically in weighted equipment it is necessary to set up and change the apparatus so as to change the angle at which one is working and this consumes considerable time compared to the quick change that can be made using the exerciser of this invention. Also, where working with a weight set one is working against gravity and it is evident that any change in the angle of tilt and attach of the system relative to the body movements is considerably more difficult to achieve. If attempted by a person solely by the disposition of the weight relative to the body and supported by the body such would be nearly, or possible, due to the propensity push a weight at the most favorable inclination. It is also found that the user of the present invention obtains an excellent feedback sense of the users own body condition almost spontaneously and immediately so that the exerciser may be most efficiently used in a mode of movement involving stretching which is sometimes called contract-relax. The principle involves contracting a muscle and after working the same relaxing it and then attempting to stretch it. Several of the exercises disclosed herein admit of this type of progression (see particularly FIG. 14).

FIG. 18 illustrates a predominantly abdominally oriented exercise. Generally, the exerciser is gripped by the end knobs, palms inward, the stomach muscles are pulled in as much as possible while the abdomen is also pushed against the bar staff which is drawn in to create a resistance primary muscles utilized in the abdomen: the rectus abdominus, internal oblique, external oblique, transverse abdominus. The shoulder muscles which are utilized are the teres major, posterior deltoid, latissimus dorsi, pectoralis major, wrist flexors.

In FIG. 19 shows a curling exercises involving the muscles of the wrist and forearm.

FIGS. 20 and 21 illustrate a use of the exerciser in combination with an aerobic walk. Generally, walking is considered to represent an exercise which involves a considerable amount of dead-time since neither the upper body or the mind are particularly active. Confining the utility of the present invention to the upper body shows that it is possible to perform many of the exercises set forth above in combination with brisk walking. It has been found that if combined with jogging the feet is performable but places considerable aerobic exertion on the body. With walking, a total exercise program can be developed which is a highly time conservative since a moderate walking pace can be converted with the addition of these exercises from less than aerobic into an aerobic conditoning program while simultaneously toning the upper body and arms and hands.

FIG. 22 involves pushing of the foot up against the bar which extended between the foot and the outstretched arm and hand, this primarily exercises the dorsi flexion and tibialis anterior and toe extensors.

FIG. 23 involves medial and lateral rotation and the following muscles groups: subscapularis, teres major, latissimus dorsi, pectoralis major, teres minor, infraspinatus.

FIG. 24 utilizes the staff of the exerciser which is held in front of the user with each hand grabbing the furthest distance possible or the most comfortable position. The bar may be gripped supanated or pronated with both hands, or the grip may be alternated. In the latter case, for example, the left hand may be supanated or palm up with the right hand palm down or pronated. When flexed at the same time the bar will not move because the right hand would tend to roll the bar forward and the left hand would then roll it backwards. This works the flexors of the wrist, hand and fingers. If the direction of force is reversed and extension of the wrist is attempted a working of all of the extensors of the hand, wrist and fingers will be obtained. This is basically an isometric exercise. However, permitting some type of difference in the amount of force applied between each hand permits a dynamic or isotonic movement to occur working these muscles through a range of motion.

FIG. 25 illustrates a simple finger adduction exercise obtained by using the staff of the exerciser.

FIG. 26 illustrates the use of the exerciser in a position seated, for example, while resting after having walked or jogged a distance or for other reasons. Here scapular elevation is attempted while the exerciser is held underneath the upper legs towards the knees.

I wish to point out that the term isokinetic is used herein in a reasonably broad sense, although included as an action within isotonic, while isotonic connotes that the force of exertion may vary as a function of the specific angular position within the required ROM, isokinetic infers movement with constant angular velocity and variable force. More broadly the present invention permits simulation of an exercise program which is isokinetic but also one in which the resistance to an exerted force may be increased in proportion to it both in concentric contraction and in eccentric contraction. These options are usually not available and are not known to be available in such a simple exercise device.

To persons familiar with the exercise physiology art, many alternatives and variations and other exercises similar to and different from those set forth in here will occur as well as minor variations of construction of the exerciser as set forth. For example, the invention has been disclosed as constructed in wood, or solid plastic, both of which are nearly rigid materials. If constructed in an elastomeric material, as previously disclosed with respect to obtaining a good grippable feel, such material may also be selected to have sufficient give so as to allow a gross turning motion, axially of the shaft and over the span of the exerciser. This would provide a limited rotational range of motion with increasing resistive force. Furthermore, the same material will give somewhat in compression, so that a certain amount of squeezing exercise, as could be performed by the fingers pressing toward the palm, can be performed. Accordingly, such modifications to the exerciser and adaptations of the same to various exercise programs should be considered to be within the scope of the present invention, which should only be taken as limited by the following claims of which:

I claim:

1. An exerciser characterized by an elongate cylindrical shaft having at each end a hand grip in the form of an enlarged coaxially mounted disc-like knob, said knob having an outwardly convex end face and a rounded peripheral region, said knob having a pattern of grooves formed therein for providing gripping surface against slippage of the hand both axially and circumferentially, the peripheral region of each hand grip being formed with a plurality of scalloped indentions forming a regular array of concave oval figures thereabout for admitting the inner sides of the fingers from the first joint to the knuckles, said knob having further inwardly a substantially flat facing finger tip gripping surface formed by a wall thereat and generally curved in a relatively shallow S-shape to accommodate the curve of the finger at the first point at the point of its curvature thereabouts and a lower convex portion for conforming to the shape of the tip of the finger and smoothly contoured into the extent of the rod, said hand grip and said inwardly facing surface having a diameter corresponding to the hand grip, D, of a human adult, an axial thickness of the order of 0.4 D, and said rod having a diameter of the order of about 0.5 D and a length of the order of 3 D.

2. The exerciser as in claim 2 further in which the opposed inwardly directed end faces of each hand grip define a plurality of concentric grooves therein for providing substantial finger grip against radial movement.

3. The exerciser of claim 2 in which said shaft and end knobs are formed of a material having an aggregate specific gravity approximately neutral or slightly greater than that of water.

4. The exerciser as in claim 2 made of wood.

5. The exerciser as in claim 2, the same being made of polypropylene plastic.

6. The exerciser as in claim 2, the same being made of a semi-rigid rubber material.

7. An exerciser having no moving parts and adapted for a variety of isometric and isotonic exercise motions comprising an elongate staff of cylindrical cross section, a pair of end knobs in the form of circular hubs mounted to each end of the staff and forming opposed hand grips thereat, each of said and knobs being dimensioned and shaped in the form of a circular disc mounted coaxial with the shaft and having a convex palm contact and surface outwardly facing therefrom, a rounded peripheral region about which fingers can curl, a substantially flat inwardly facing finger grip wall including means forming concentric grooves in said inwardly facing wall extending from the peripheral region into contact with the staff, said inwardly facing wall having a diameter at least approximately double the diameter of said staff, said staff and knobs having an overall dimension of about chest width, said staff having a circumferential dimension approximating that of a tennis grip.

8. An exerciser having no moving parts and adapted for a variety of isometric and isotonic exercise motions comprising an elongate staff of cylindrical cross section, a pair of end knobs in the form of circular hubs mounted to each end of the staff and forming opposed hand grips thereat, each of said end knobs being dimensioned and shaped in the form of a circular disc mounted coaxial with the shaft and having a convex palm contact end surface outwardly facing therefrom, a rounded peripheral region about which the fingers can curl, a substantially flat inwardly facing grip wall extending from the peripheral region into contact with the staff, said inwardly facing wall having a diameter at least approximately double the diameter of said staff, said staff and knobs having an overall dimension of about chest width, said staff having a circumferential dimension approximating that of a tennis grip, said outer convex end surface of said knobs being provided with a palm gripping surface approximating a portion of a sphere having a radius centered on the axis of the exerciser shaft and a length commensurate with the curvature of the palm, said palm gripping surface including a plurality of grooves emanating from the center of said wall.

9. An exerciser having no moving parts and adapted for a variety of isometric and isotonic exercise motions comprising an elongate staff of cylindrical cross section, a pair of end knobs in the form of circular hubs mounted to each end of the staff and forming opposed hand grips thereat, each of said end knobs being dimensioned and shaped in the form of a circular disc mounted coaxial with the shaft and having a convex palm contact end surface outwardly facing therefrom, a rounded peripheral region about which the fingers can curl, a substantially flat inwardly facing grip wall extending from the peripheral region into contact with the staff, said inwardly facing wall having a diameter at least approximately double the diameter of said staff, said staff and knobs having an overall dimension of about chest width, said staff having a circumferential dimension approximating that of a tennis grip, said rounded peripheral region being provided with a plurality of adjacent finger relief recesses having the appearance of scallops formed about the periphery of said region, and a palm gripping surface provided in said outer wall and comprising a plurality of radially extending grooves emanating from the center of said outer wall and each of said grooves aligned to register with one of said recesses.

* * * * *